US009358090B2

(12) United States Patent
Taylor et al.

(10) Patent No.: US 9,358,090 B2
(45) Date of Patent: Jun. 7, 2016

(54) AIR INJECT SYRINGE DART

(71) Applicant: Palmer Cap-Chur Patent LLC, Powder Springs, GA (US)

(72) Inventors: Tommy Taylor, Powder Springs, GA (US); John Gober, Powder Springs, GA (US)

( * ) Notice: Subject to any disclaimer, the term of this patent is extended or adjusted under 35 U.S.C. 154(b) by 163 days.

(21) Appl. No.: 14/267,109

(22) Filed: May 1, 2014

(65) Prior Publication Data

US 2015/0313698 A1 Nov. 5, 2015

(51) Int. Cl.
*A61D 7/00* (2006.01)
*F42B 12/54* (2006.01)

(52) U.S. Cl.
CPC .. *A61D 7/00* (2013.01); *F42B 12/54* (2013.01)

(58) Field of Classification Search
CPC ..... A61D 7/00; F42B 12/54; F42B 6/06; F42B 12/362; F42B 10/64; F42B 10/14; F42B 10/06; F42B 10/26; F42B 12/40; F42B 12/46; F42B 12/36
USPC ..... 604/99.03, 99.04, 9, 45, 69, 70, 335; 473/578–586; 244/3.24, 3.27; 102/502, 102/508, 512, 513
See application file for complete search history.

(56) References Cited

U.S. PATENT DOCUMENTS

| | | | | |
|---|---|---|---|---|
| 3,715,990 | A | 2/1973 | Palmer | |
| 4,103,893 | A | 8/1978 | Walker | |
| 4,684,366 | A | 8/1987 | Denny et al. | |
| 4,735,611 | A | 4/1988 | Anderson et al. | |
| 4,863,428 | A | 9/1989 | Chevalier | |
| 5,015,237 | A | 5/1991 | Kleinwolterink et al. | |
| 5,202,533 | A | 4/1993 | Vandersteen | |
| 5,295,971 | A | 3/1994 | Cameron | |
| 5,306,251 | A | 4/1994 | Alexander | |
| 5,607,395 | A | 3/1997 | Ragsdale et al. | |
| 6,482,187 | B1 | 11/2002 | Gibbs | |
| 6,584,910 | B1 | 7/2003 | Plass | |
| 6,605,059 | B1 * | 8/2003 | Middleton | F42B 12/54 604/130 |
| 2010/0102161 | A1 * | 4/2010 | Geswender | F42B 10/16 244/3.27 |
| 2012/0040786 | A1 * | 2/2012 | Ng | A63B 67/18 473/579 |

OTHER PUBLICATIONS

Donald Reid, Colin Murdoch—Dreamer for Millions, Dec. 20, 1999, NZEDGE.com, available at http://www.nzedge.com/legends/colin-murdoch/.*

Oxford Dictionaries, Definition of Bevel, checked Dec. 9, 2015, available at http://www.oxforddictionaries.com/us/definition/american_english/bevel.*

Donald Reid, Colin Murdoch—Dreamer for Millions, Dec. 20, 1999, NZEDGE.com, available at http://www.nzedge.com/legends/colin-mu rdoch/.*

* cited by examiner

*Primary Examiner* — Edelmira Bosques
*Assistant Examiner* — Amber Stiles
(74) *Attorney, Agent, or Firm* — Moore, Ingram, Johnson & Steele, LLP

(57) ABSTRACT

A syringe for remotely treating an animal with medicine including a cylindrical barrel, a soft plunger which moves longitudinally within the cylindrical barrel in response to air pressure within the barrel, a tailpiece end cap, a tailpiece, a safety cap, and a needle for penetrating the target upon impact; wherein the tailpiece provides stabilization of the syringe in flight over greater distance and in inclement weather.

6 Claims, 14 Drawing Sheets

AIR INJECT SYRINGE DART

FIELD OF THE INVENTION

The present invention relates to projectiles directed to the delivery of a medicine into animals by injection from a distance and, more particularly, to an injecting syringe dart.

BACKGROUND

There are many known methods for delivering medicine to animals. One of the most common and well known methods is the syringe, used for injecting medicine under the skin or into the musculature of an animal. Handheld syringes may be used to deliver medicine; however, they require close proximity to the animal, which is often not desirable. Many methods have been developed for injecting animals from a safe distance via projection of the injecting apparatus, most commonly, a syringe. The more successful of these projectile syringes result in accurate placement of the syringe, quick injection of the medicament upon contact with the animal, safe handling of the syringe prior to projection and after injection into the animal, proper pressurization of the syringe during flight, and minimal tissue damage to the animal.

Several variations of projectile syringes have been put forth, a majority of which involve a plunger piston that must be depressed by force and either do not include a tailpiece or include only simple guide fins. U.S. Pat. No. 3,715,990 discloses a dart projectile with a cylinder plunger piston that encompasses an explosive charge. The impact of the projector causes an explosive charge, which depresses the plunger piston causing the medication to be injected into the animal. U.S. Pat. No. 6,482,187 discloses a syringe including a barrel, a plunger piston which moves longitudinally within the barrel in response to air pressure within the barrel, and a syringe needle for penetrating the hide of an animal and for introducing medication to the animal. Prior to loading the syringe into the projector, the medication chamber is filled with medicine and the syringe is then pressurized. As is common when a plunger piston is used, the syringe has no tailpiece to speak of, consisting of the plunger piece instead. U.S. Pat. No. 4,102,893 proposed a syringe with an alternative to the plunger piston projectile utilizing the force impact with the animal to release a piston by means of a triggering pin. However, such mechanical force impact syringes are unreliable when used with a $CO_2$(g) fired projector or an air gun and are generally limited to use with a blowgun or similar device.

A more desirable syringe would instead utilize a one-way valve mechanism, enabling the syringe to be pressurized either by hand prior to being fired from the projector or by the action of the projector in firing the syringe. Such a valve mechanism would eliminate the need for a plunger piston, explosive charge and/or a mechanical force of impact triggering mechanism and allows for the use of a greater variety of projectors including compressed gas projectors such as a $CO_2$(g) fired projectors and air guns. Additionally, the desired syringe would include a tailpiece that would allow air to flow through and around the fins thereby increasing stability in flight and allowing for greater accuracy of syringe dart placement over a greater trajectory and in inclement weather and windy conditions. The desired syringe would also include a safety cap that would be punctured by the needle only upon impact with the animal's hide and would then slide back into a hub on the syringe. The desired syringe with such a safety cap would then be safe for storage and loading into the projector without harm to humans.

SUMMARY OF THE INVENTION

The present invention provides a syringe dart, or projectile, for the remote injection of a medicine into an animal. The term medicine is to be interpreted broadly throughout this specification, including, but not limited to a tranquilizing agent, an analgesic agent, a contraceptive, a worming agent, a pharmaceutical agent and/or a therapeutic agent. The term animal is to be interpreted broadly throughout the specification, including, but not limited to wildlife such as a deer, elk or bear, livestock used for commercial purposes such as cattle, horses or ostrich, a feral animal such as a pig or wild dog, zoological specimens, or large marine mammals such as a seal or walrus. In a preferred embodiment, the syringe dart of the present invention comprises a cylindrical barrel, a tailpiece end cap, a nosehub, a soft plunger which moves longitudinally within the cylindrical barrel in response to air pressure within the barrel, a syringe needle for introducing a medicine into the animal after the hide has been penetrated, and a tailpiece containing a plurality of longitudinal fins that provide stability to the dart in flight. The soft plunger separates the interior of the cylindrical barrel into an air pressure chamber and a medicine chamber. Prior to use, the medicine chamber is filled with the amount and type of medicine required.

In another preferred embodiment, the tailpiece end cap contains an air vent and the tailpiece contains an air vent. The tailpiece fits securely within the tailpiece end cap and within the overlapping space is a one-way air valve that allows for the syringe to be pressurized manually with air or any other compressed liquid or gas. A tail piece plug is used to cover the air vent of the tailpiece after the syringe is pressurized manually. Once pressurized and after firing the syringe with a projector or gun, the change in air pressure in the chamber causes the soft plunger to move longitudinally down the cylindrical barrel, pushing the medicine towards the needle. In a preferred embodiment, a safety cap on the end of the needle initially prevents the medicine from being eliminated from the barrel. However, upon impact with the animal hide, the needle pushes through the safety cap, allowing for the medicine to be injected into the animal.

In another preferred embodiment, a sleeve insert is located within the cylindrical barrel between the tailpiece end cap and the soft plunger to allow for air flow within the cylindrical barrel. This ensures an accurate pressurization can be achieved and that an accurate amount of medication is administered to the animal. The sleeve insert may be glued or otherwise affixed within the cylindrical barrel.

Another aspect of the invention is that manually pressurizing the syringe is not necessary if the projector, or gun, used is a $CO_2$(g) fired projector. A $CO_2$(g) fired projector, or gun, pressurizes the syringe upon firing. Once the syringe is fired, the air pressure in the chamber causes the soft plunger to move longitudinally down the cylindrical barrel, pushing the medicine towards the needle. A tail piece plug is not needed when a $CO_2$(g) fired projector is used for firing the syringe of the present invention.

In another preferred embodiment, the tailpiece contains a plurality of flexible longitudinal fins. The plurality of longitudinal fins of the tailpiece are flexible to allow for flat loading into a projector, or gun. However, in the preferred embodiment, the angle of the longitudinal fins at rest is 156.0188° relative to the base of the tailpiece. It is understood that the fins are flexible from 90° to 180° from the base of the tailpiece. This flexibility allows for the syringe to be used in a broader range of barrel sizes of projectors, or guns. The longitudinal fins each contain apertures for stability in flight thereby increasing the accuracy over a greater distance and allowing for the greater accuracy in inclement, windy, or less than optimal weather conditions. The apertures allow for gas or air to escape around the syringe letting it, in effect, ride on the air or gas down the barrel of the projector, or gun, which keeps the syringe from making undue noise as it exits the barrel and therefore reducing the risk of startling or alerting the animal. In a preferred embodiment the apertures are oval in shape, centered on the length of the fin, and beveled at the distal end. However, it is understood that the apertures may be of any shape or dimension and each longitudinal fin may contain more than one aperture.

In yet another preferred embodiment of the present invention, the safety cap covering the needle after the medicine has been added to the syringe is designed such that upon impact with the animal hide, the needle pushes through the safety cap. The safety cap is then pushed down into the nosehub so that the needle may have complete penetration allowing for all of the medication to be injected subcutaneously.

Methods for attaching the components of the syringe to the cylindrical barrel include, but are not limited to gluing and threading as a screw. It is understood that the components must be affixed in such a manner as to be able to withstand the force of the projector, or gun.

It is understood that the components of the syringe are preferably made from a lightweight plastic, metal, or composite material that provides sufficient strength to withstand the force of the projector, or gun. In another embodiment, several or all of the components, including the barrel may be made of one piece of molded plastic or other composite material.

Other aspects, features, and advantages will become apparent to those skilled in the art from the detailed description and accompanying drawings. It should be understood, however, that the detailed description and accompanying drawings, while indicating preferred embodiments of the present invention, are given by way of illustration and not limitation.

DETAILED DESCRIPTION OF THE INVENTION

Figure 1:
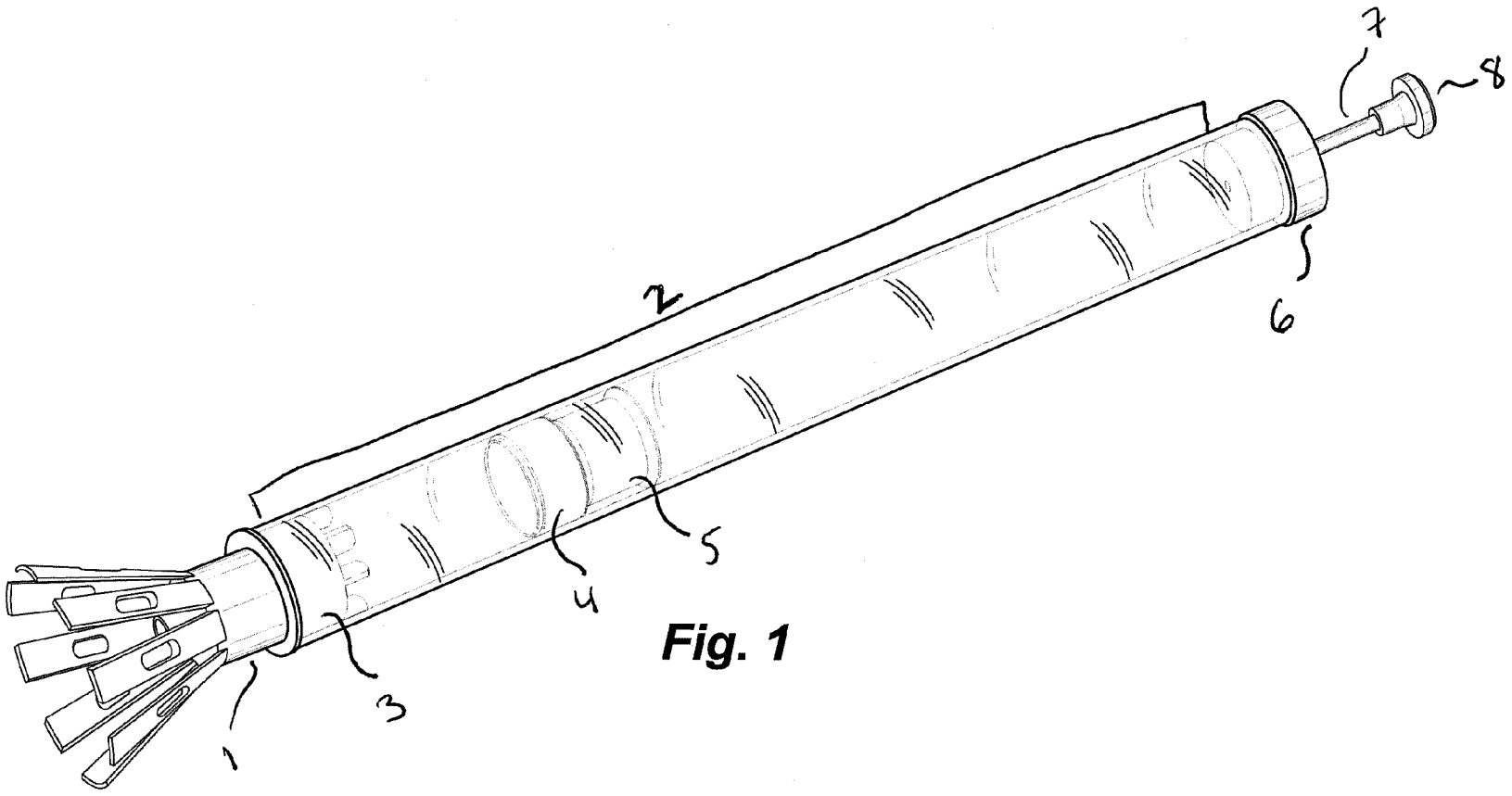
FIG. 1 is a perspective view of an embodiment of an air inject dart in accordance with the present invention.

FIG. 1 illustrates an air inject syringe, or projectile of the present invention. The major components include a cylindrical barrel 2 having a tailpiece end cap 3 at the rear, or proximal end of the cylindrical barrel 2, a tailpiece 1 which is affixed to tailpiece end cap 3, a sleeve insert 4, a soft plunger 5 which slides longitudinally within the barrel, a nosehub 6 at the forward or distal end of the cylindrical barrel 2, a hollow needle 7 and a safety cap 8.

Figure 2:
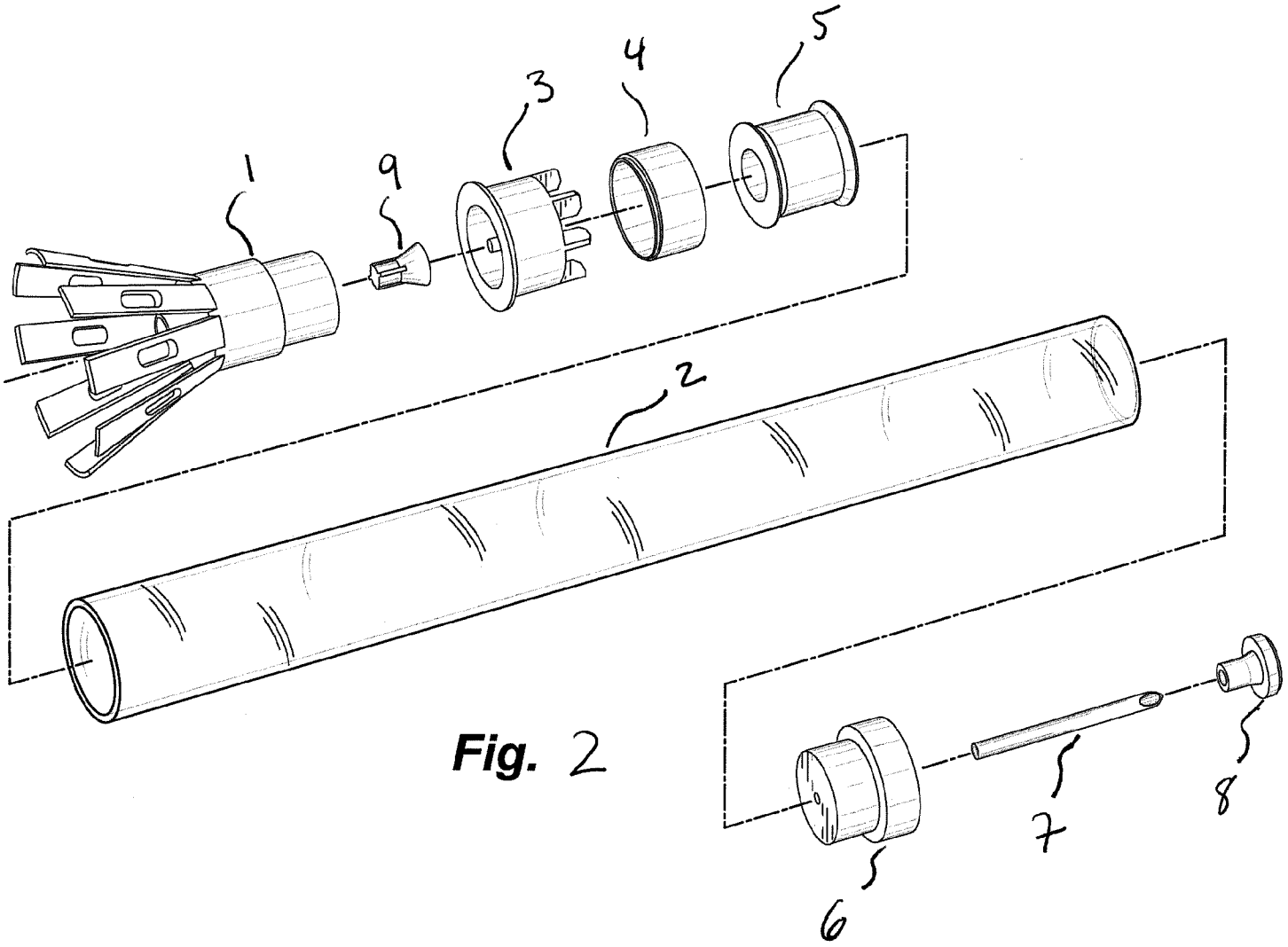
FIG. 2 shows a perspective and exploded view of FIG. 1.
Figure 3:
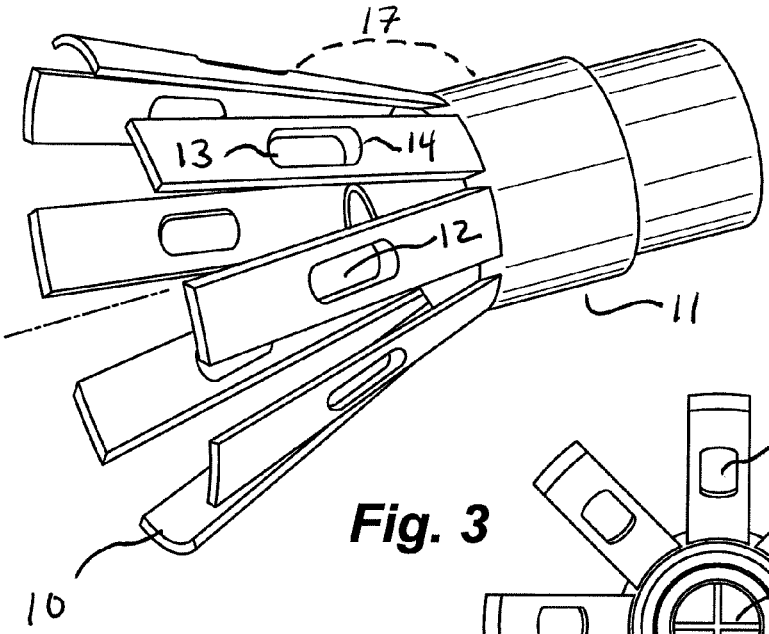
FIG. 3 is a perspective view of an embodiment of the tailpiece in accordance with the present invention.
Figure 4:
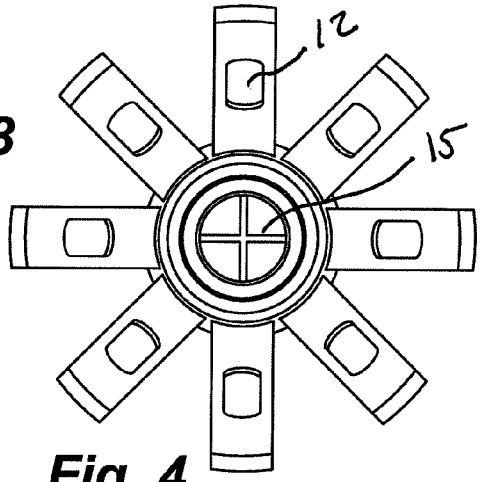
FIG. 4 is a rear perspective view of the tailpiece of FIG. 3.
Figure 5:
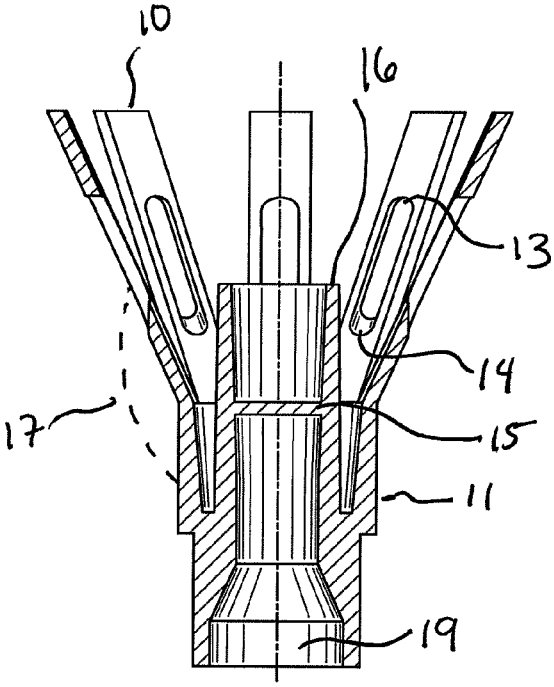
FIG. 5 is a cross-sectional view of the tailpiece of FIG. 3.
Figure 6:
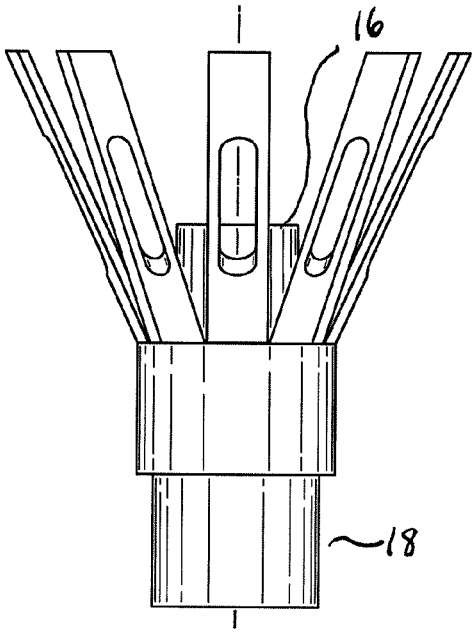
FIG. 6 is a side view of the tailpiece of FIG. 3.

As depicted in FIG. 2, an air valve 9, is located within the joint of tailpiece 1 and tailpiece end cap 3.

FIGS. 3-6 illustrate tailpiece 1, wherein a plurality of longitudinal stabilizing fins 10 are attached to the rear or proximal end of base 11 of the tailpiece 1. In the embodiment shown of the present invention, at rest, the angle 17 of the longitudinal stabilizing fins relative to base 11 is 156.0188°. However, it is understood that the longitudinal stabilizing fins 10 are flexible and that angle 17 may range from 90° and 180° relative to the base 11 of the tailpiece 1. The longitudinal stabilizing fins 10 each contain an aperture 12. The aperture 12 is oval in shape and a rear or proximal end 13 of the aperture is the width of the longitudinal stabilizing fin 10, while a forward or distal end 14 of the aperture, is beveled toward the base 11. The tailpiece 1 contains an air vent 15 such that air may move longitudinally through the tailpiece 1. The tailpiece 1 also contains a receiving port 16 for manually filling the syringe with air or compressed gas. The distal end of base 11 contains a smaller cylinder 18 that fits within the tailpiece end cap 3 while opening 19 contains the air valve 9.

The longitudinal stabilizing fins 10 and apertures 12 allow for air to escape around the syringe as it exits the barrel of the projector, or gun, which prevents the syringe from making a "popping' noise when it exits the barrel, which prevents startling the intended animal target. The apertures 12 and longitudinal stabilizing fins 10 also create greater stability in flight that allows for improved accuracy over greater distances and inclement weather. Moreover, the flexibility of the longitudinal stabilizing fins 10 allows for use in a wide range of projectors, or gun barrels.

Figure 7:
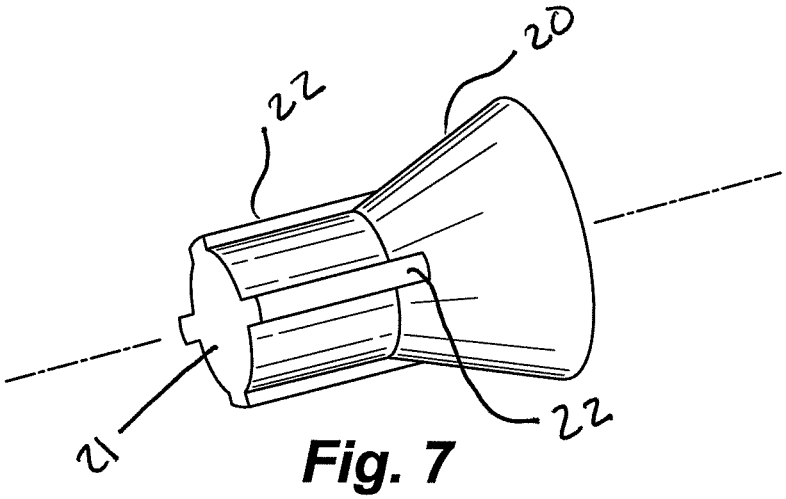
FIG. 7 is a perspective view of an embodiment of the air valve in accordance with the present invention.
Figure 8:
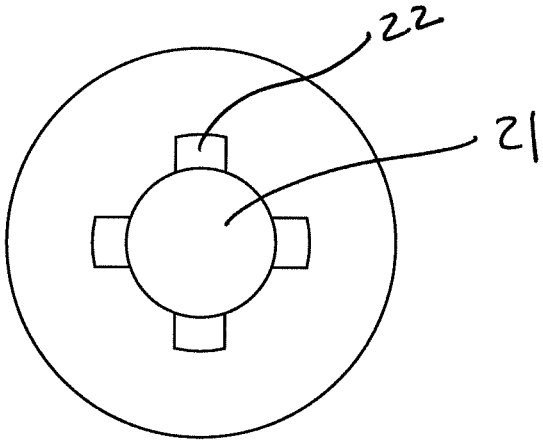
FIG. 8 is a front view of the air valve of FIG. 7.
Figure 9:
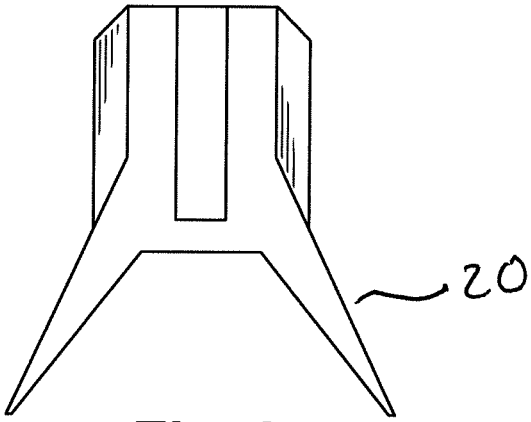
FIG. 9 is a cross-sectional side view of the air valve of FIG. 7.
Figure 10:
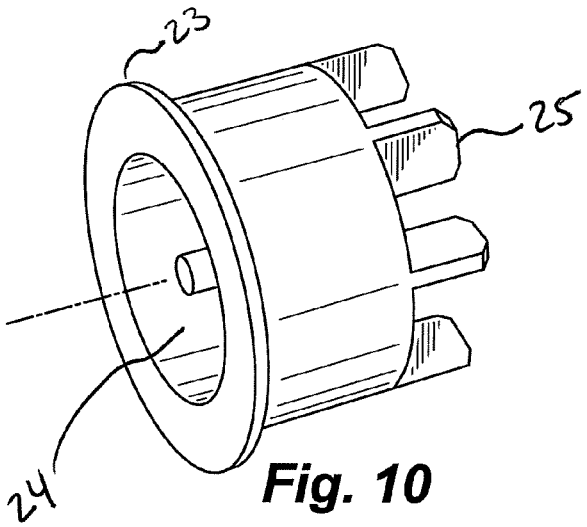
FIG. 10 is a perspective view of an embodiment of the tailpiece end cap in accordance with the present invention.
Figure 11:
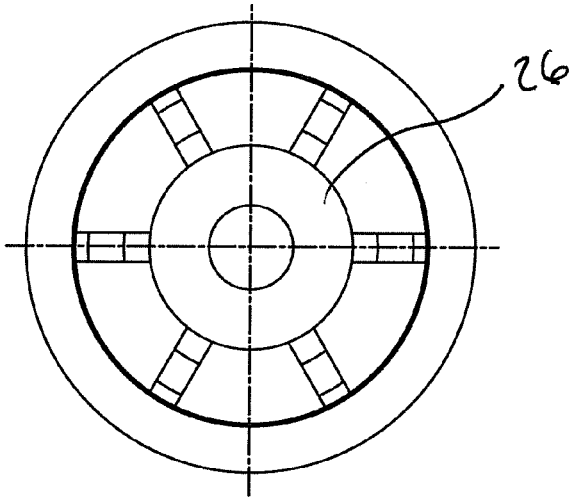
FIG. 11 is a rear view of the tailpiece end cap of FIG. 10.
Figure 12:
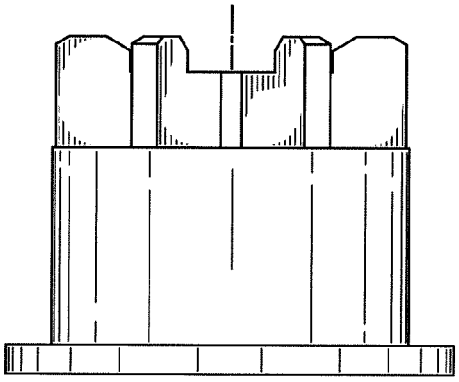
FIG. 12 is a side view of the tailpiece end cap of FIG. 10.
Figure 13:
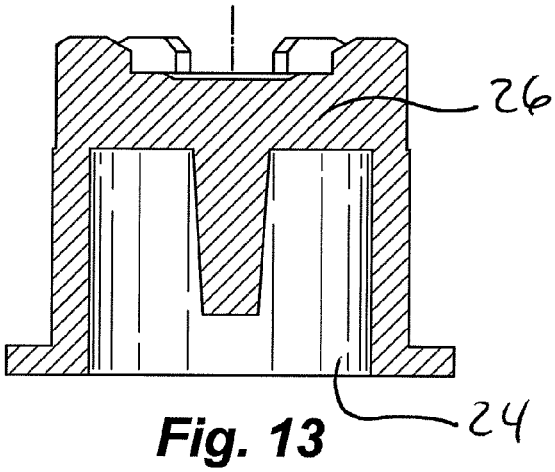
FIG. 13 is a cross-sectional side view of the tailpiece end cap of FIG. 10.
Figure 14:
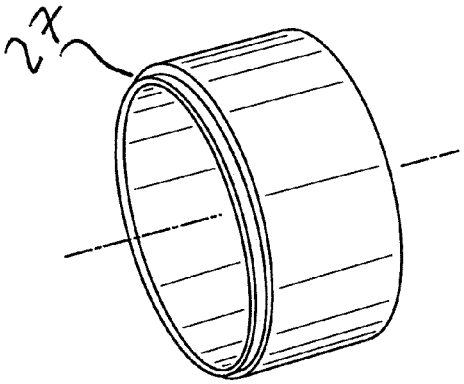
FIG. 14 is a perspective view of an embodiment of the sleeve insert in accordance with the present invention.
Figure 15:
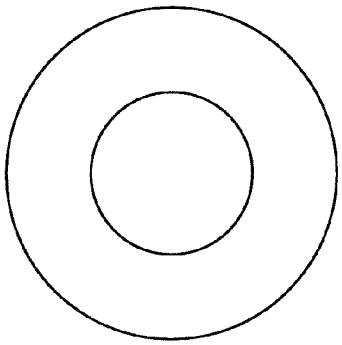
FIG. 15 is a rear view of the sleeve insert of FIG. 14.
Figure 16:
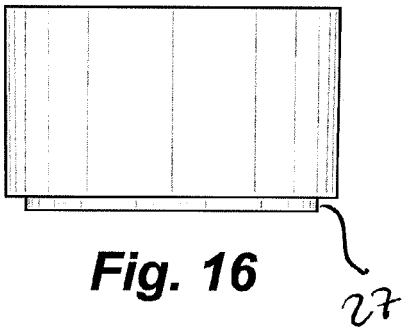
FIG. 16 is a side view of the sleeve insert of FIG. 14.
Figure 17:
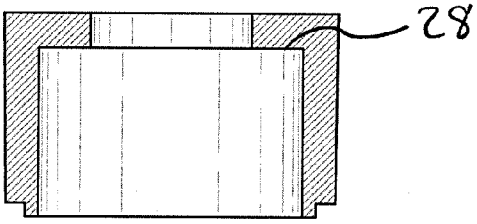
FIG. 17 is a cross-sectional side view of the sleeve insert of FIG. 14.
Figure 18:
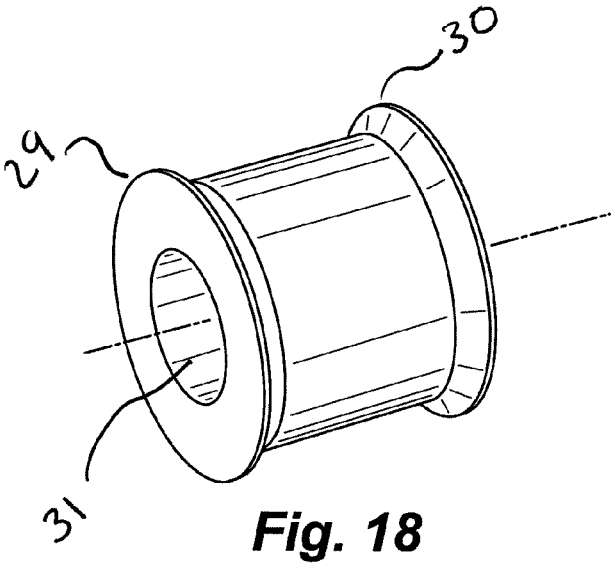
FIG. 18 is a perspective view of an embodiment of the soft plunger in accordance with the present invention.
Figure 19:
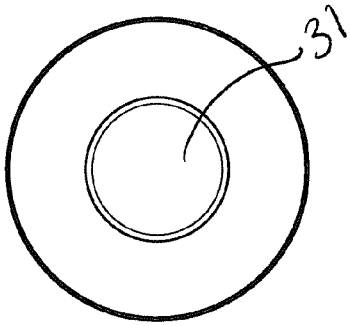
FIG. 19 is a rear view of the soft plunger of FIG. 18.
Figure 20:
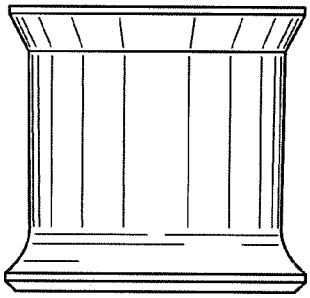
FIG. 20 is a side view of the soft plunger of FIG. 18.
Figure 21:
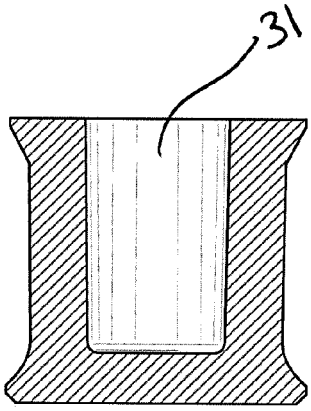
FIG. 21 is a cross-sectional side view of the soft plunger of FIG. 18.
Figure 22:
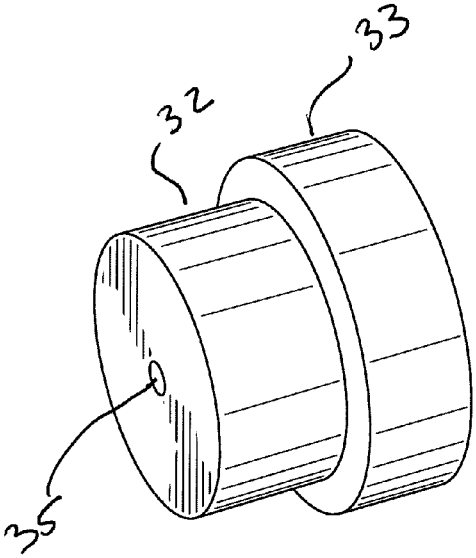
FIG. 22 is a perspective view of an embodiment of the nosehub in accordance with the present invention.
Figure 23:
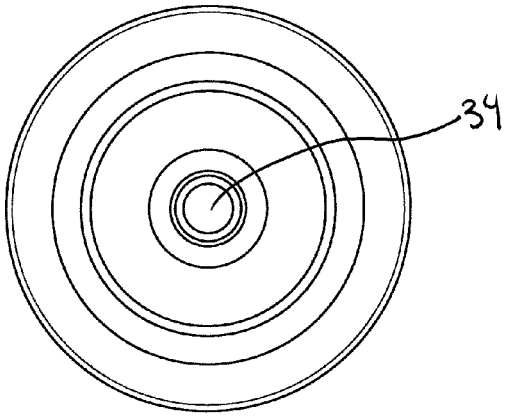
FIG. 23 is a rear view of the nosehub of FIG. 22.
Figure 24:
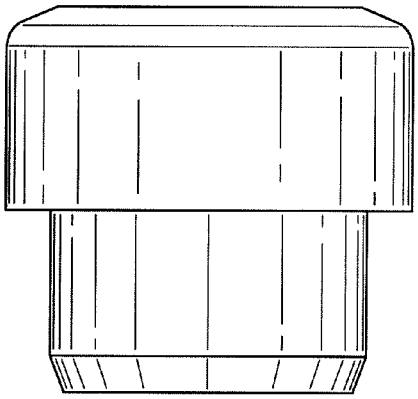
FIG. 24 is a side view of the nosehub of FIG. 22.
Figure 25:
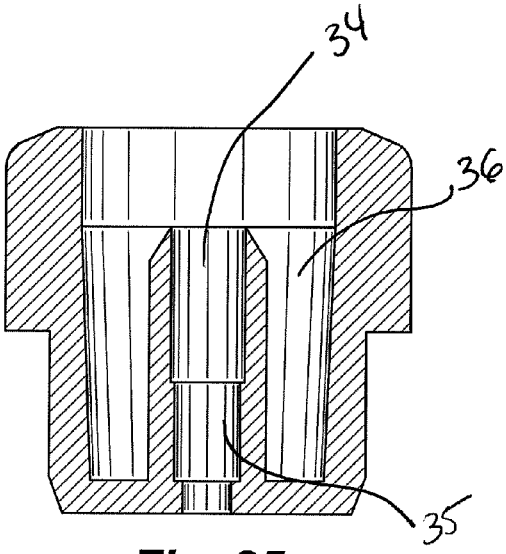
FIG. 25 is a cross-sectional side view of the nosehub of FIG. 22.

FIGS. 7-9 illustrate the air valve 9 that is located within the joint of the tailpiece 1 and the tailpiece end cap 3. The air valve 9 contains a conical base 20 that is inserted in the tailpiece end cap 3, and a cylindrical top 21 that contains a plurality of fins 22 that extend the length of the top 21 to the conical base 20.

FIGS. 10-13 illustrate the tailpiece end cap 3. The tailpiece end cap 3 contains a lip 23 at the rear or proximal end and secures the tailpiece end cap at the rear or proximal end of the cylindrical barrel 2. The rear or proximal end of the tailpiece end cap contains a portal 24 for receiving the conical base 20 of the air valve and the smaller cylinder 18 of the tailpiece 1. The forward or distal end of the tailpiece end cap 3 contains a plurality of fins 25 to direct air flow. Situated within the tailpiece end cap 3 is air vent 26.

FIGS. 14-17 illustrate the sleeve insert 4. The rear or proximal end of the sleeve insert contains an exterior lip 27 and the forward or distal end of the sleeve insert contains an interior lip 28.

FIGS. 18-21 illustrate the soft plunger 5. The soft plunger 5 is cylindrically shaped with a protruding edge 29 at the rear or proximal end and a protruding edge 30 at the distal or forward end to provide a seal between the medicine and air chambers in the cylindrical barrel 2. The rear end of the soft plunger contains a cylindrical shaped depression 31 that allows for more fluid movement of the soft plunger 5 within the cylindrical barrel 2.

FIGS. 22-25 illustrate the nosehub 6. The nosehub 6 contains a cylindrical shaped base 32 that is placed in the forward or distal end of the cylindrical barrel 2. The top of the nosehub 33 remains outside of the cylindrical barrel 2. The needle 7 is placed in a center opening 34 in the nosehub 6 while the base 32 contains an opening 35 that is smaller than opening 34 to prevent the needle 7 from entering the cylindrical barrel 2. The nosehub 7 also contains an area 36 to receive the safety cap 8 after the syringe has made contact with the animal.

Figure 26:
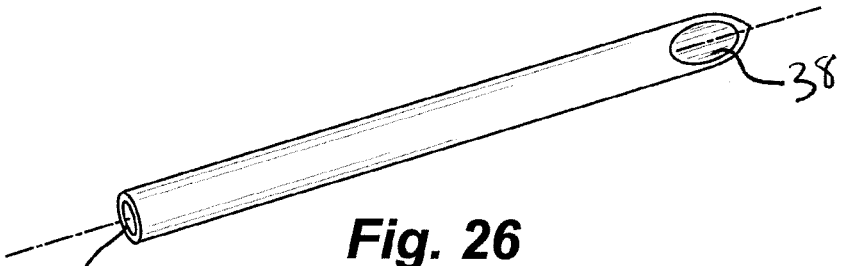
FIG. 26 is a perspective view of an embodiment of the needle in accordance with the present invention.
Figure 27:
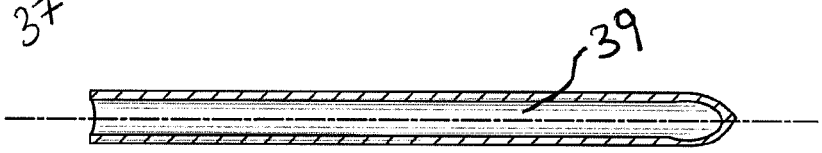
FIG. 27 is a cross-sectional side view of the needle of FIG. 26.
Figure 28:
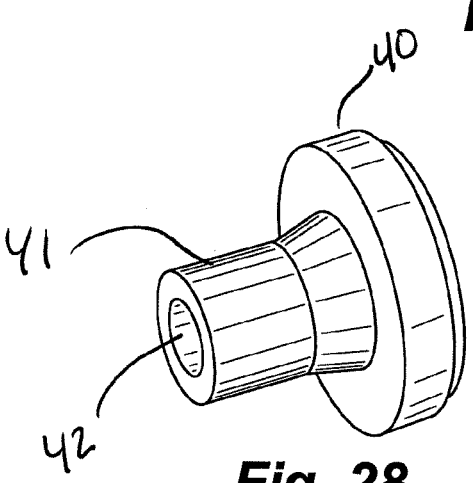
FIG. 28 is a perspective view of an embodiment of the safety cap in accordance with the present invention.
Figure 29:
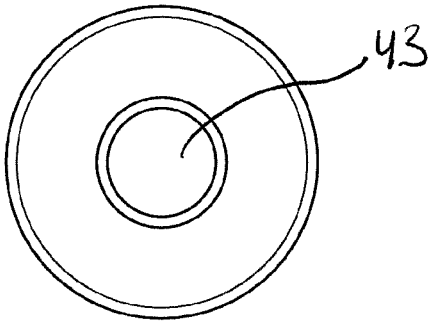
FIG. 29 is a front-view of the safety cap of FIG. 28.
Figure 30:
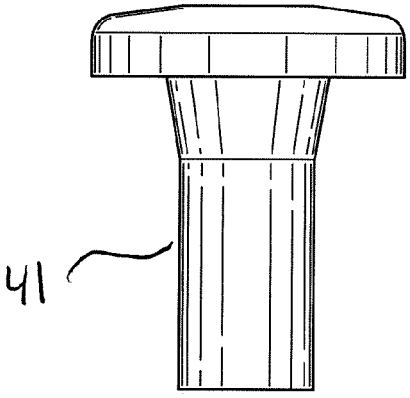
FIG. 30 is a side view of the safety cap of FIG. 28.
Figure 31:
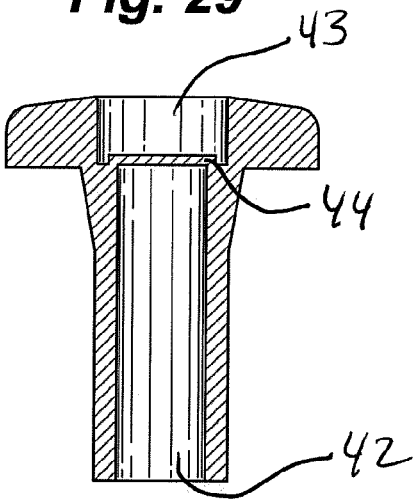
FIG. 31 is a cross-sectional side view of the safety cap of FIG. 28.

FIGS. 26-27 illustrate the interior details of the needle 7. The needle has rearward or proximal opening 37, a central passageway 39, and a forward or distal opening 38. The forward opening may be a side opening, as shown in forward opening 38, which allows for the medicine to spread out over a larger area. Alternatively, it is within the scope of the present invention, that different types of needles may be used depending upon the desired outcome. The needle 7 may be glued or otherwise affixed to the nosehub 6 to prevent leakage.

FIGS. 28-31 illustrate the safety cap 8. The safety cap 8 has a top 40 and a bottom 41, wherein the bottom contains a cylindrical depression 42 to receive the needle 7 and the top 40 contains a small depression 43 to guide the needle 7 after the syringe has made contact with the animal. Between cylindrical depression 42 and depression 43 is a thin barrier 44. Barrier 44 is punctured by the needle 7 upon impact with the animal.

Figure 32:
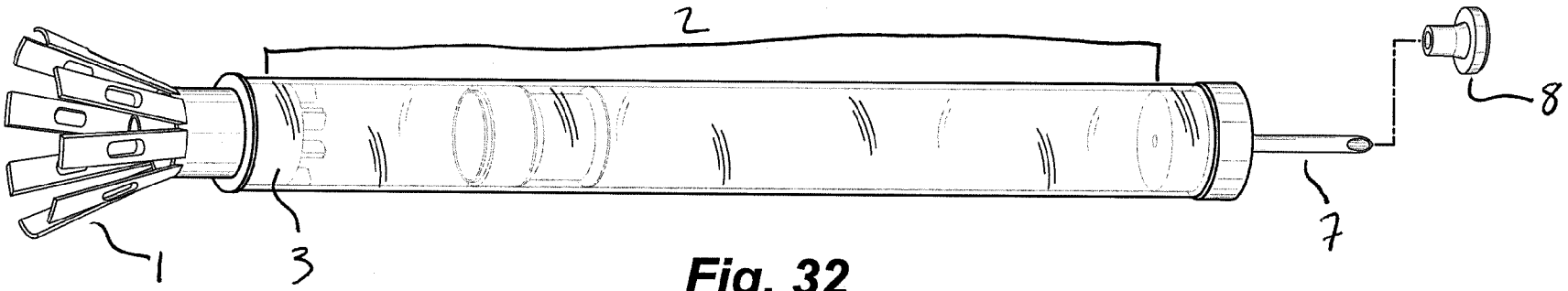
FIG. 32 is a perspective view of an embodiment of the air inject dart in accordance with the present invention wherein the safety cap has been removed from the needle.

FIG. 32 illustrates an empty syringe wherein the safety cap 8 has been removed so that the medicine may be loaded into the cylindrical barrel 2.

Figure 33:
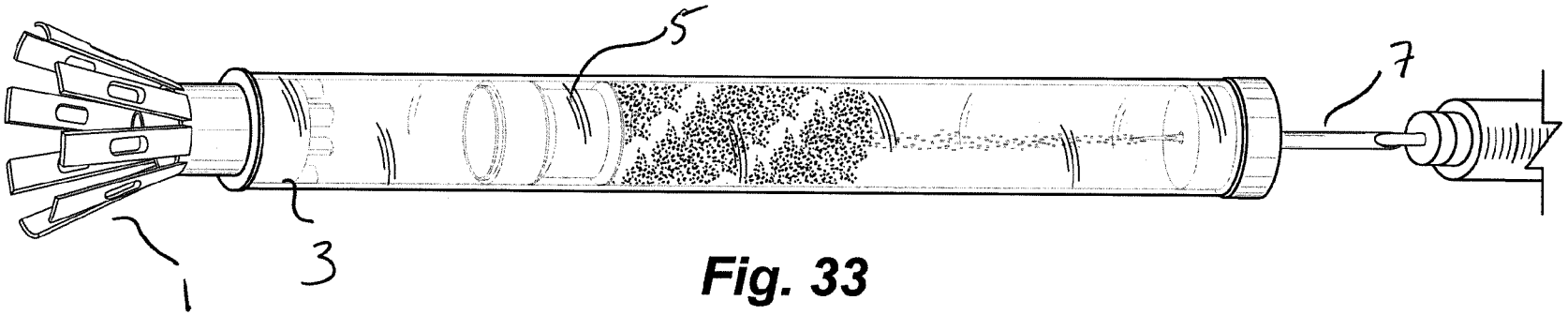
FIG. 33 is a perspective view of an embodiment of the air inject dart in accordance with the present invention wherein dart is being primed with medicine.

FIG. 33 illustrates medicine loaded into the cylindrical barrel 2 by means of a syringe through the needle 7. The soft plunger 5 prevents the medicine from passing into the rear of the cylindrical barrel 2. Once the medicine has been loaded, the safety cap 8 is replaced.

Figure 34:
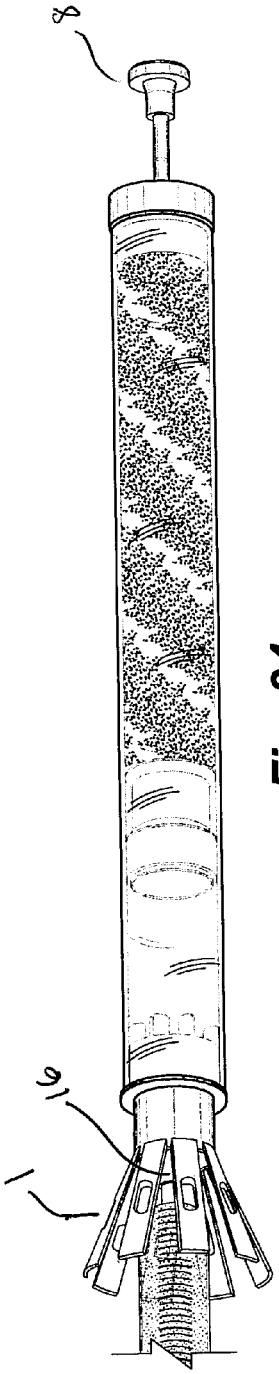
FIG. 34 is a perspective view of an embodiment of the air inject dart in accordance with the present invention wherein the dart has been primed with medicine and is about to be pressurized manually by injection through the tailpiece.
Figure 35:
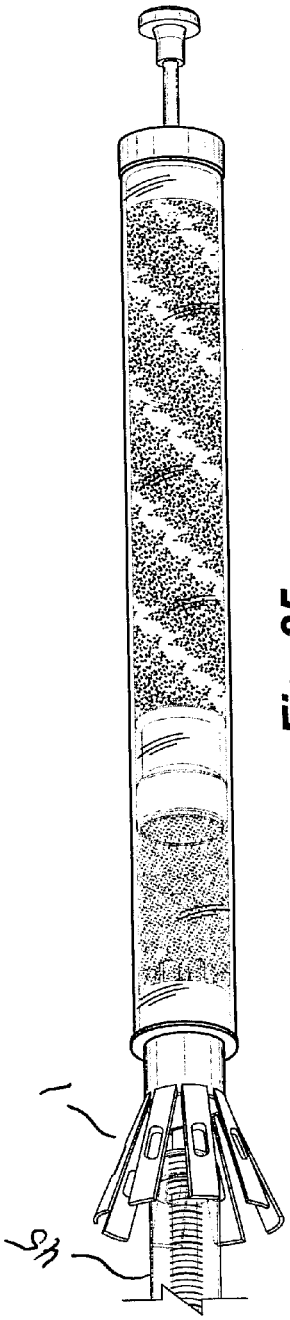
FIG. 35 is a perspective view of an embodiment of the air inject dart in accordance with the present invention wherein the dart has been primed with medicine and pressurized.
Figure 35A:
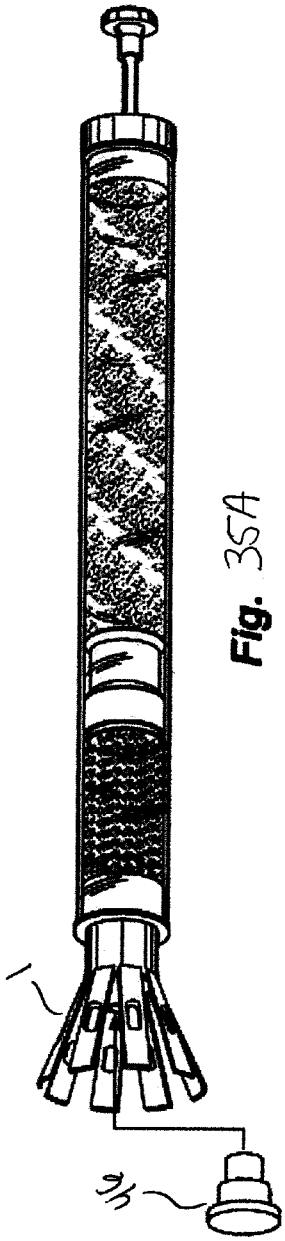
FIG. 35A is a perspective view of an embodiment of the air inject dart in accordance with the present invention wherein the tail piece plug is used to prevent depressurization prior to firing.

FIGS. 34, 35 and 35A illustrate the syringe being pressurized manually. The safety cap 8 has been replaced and a syringe 45 containing air or any other gas that may be used to pressurize the syringe is placed within the receiving port 16 manually. The air or pressurized gas is then loaded into the cylindrical barrel 2 via the air vent 15 within the tailpiece 1, air valve 9, and air vent 26 of the tailpiece end cap 3. As illustrated in FIG. 35A, if manual pressurization is used, a tail piece plug 46 must be used and, in the embodiment shown, is positioned within the receiving port 16 of the tailpiece 1.

Alternatively, air pressure or pressurized gas from a projector, or gun, can pressurize the dart as it leaves the barrel of the projector, or gun via the air vent 15 within the tailpiece 1, air valve 9, and air vent 26 of the tailpiece end cap 3.

Figure 36:
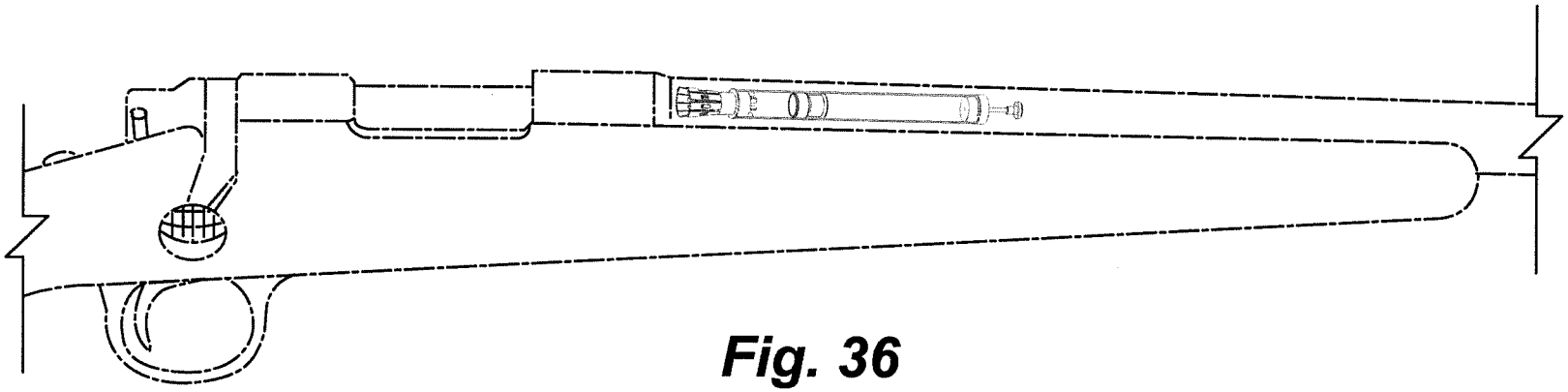
FIG. 36 is a perspective view of an embodiment of the air inject dart in accordance with the present invention wherein the dart has been loaded into a projector.

FIG. 36 illustrates the syringe within the projector, or gun. Within the projector, or gun, the stabilizing fins 10 of the tailpiece 1, are compressed and angle 17 is approximately 180° relative to the base 11 of the tailpiece 1.

Figure 36A:
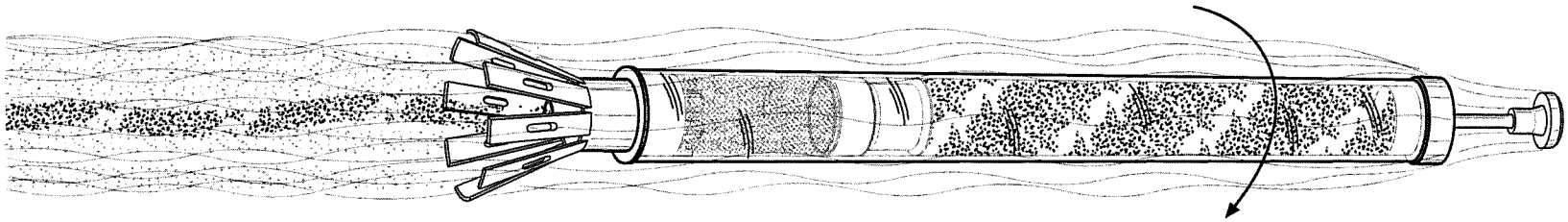
FIG. 36A is a perspective view of an embodiment of the air inject dart in accordance with the preset invention wherein the dart has been fired from a projector.

FIG. 36A illustrates the syringe after it exits the projector, or gun. The stabilizing fins 10 of the tailpiece 1 return to the preferred angle 17 of 156.0188° relative to the base 11.

Figure 39:
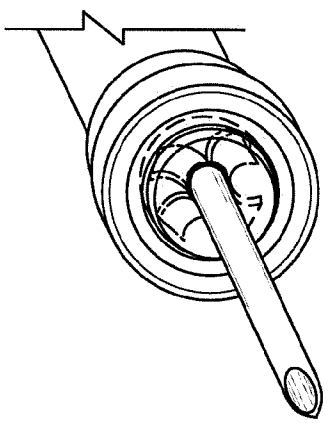
FIG. 39 is a perspective and partially transparent view of an embodiment of the air inject dart in accordance with the present invention wherein the safety cap of FIG. 28 has moved down the needle of FIG. 26 on and is contained within the nosehub of FIG. 22.
Figure 38:
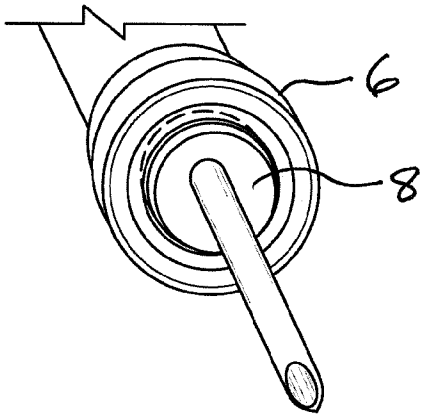
FIG. 38 is a perspective view of an embodiment of the air inject dart in accordance with the present invention wherein the safety cap of FIG. 28 has moved down the needle of FIG. 26 on and is contained within the nosehub of FIG. 22.
Figure 37:
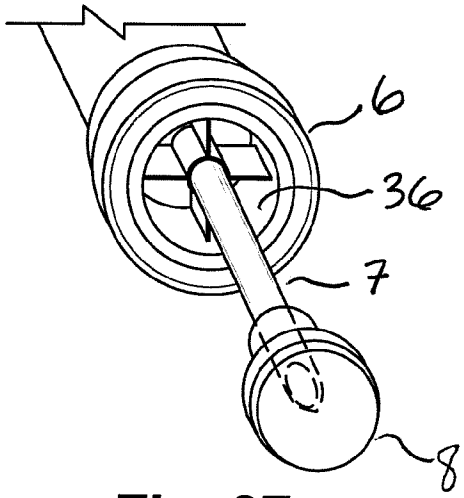
FIG. 37 is a perspective view of an embodiment of the air inject dart in accordance with the present invention wherein the safety cap of FIG. 28 is in place on the needle of FIG. 26.
Figure 40:
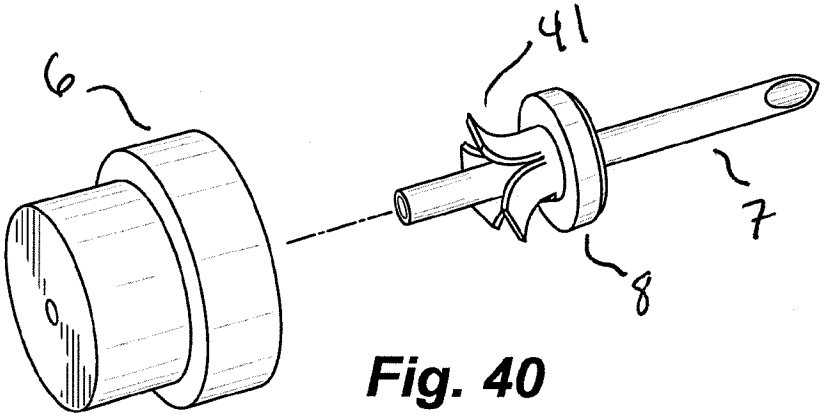
FIG. 40 is a perspective and partially exploded view of an embodiment of the air inject dart in accordance with the present invention wherein the safety cap of FIG. 28, after impact with the target animal, is moving down the needle of FIG. 26 to be contained within the nosehub of FIG. 22.

FIGS. 37-40 illustrate the action of the safety cap upon impact with the intended animal target. FIG. 37 illustrates the needle 7 and safety cap 8 prior to impact. FIG. 40 illustrates that upon impact the needle 7 pierces barrier 44 of the safety cap 8 and as the needle 7 penetrates the animal hide, the safety cap 8 is moved down the needle towards the nosehub 6. FIGS. 38 and 39 illustrate how the nosehub 6 receives the safety cap 8 in the forward opening 36 of the nosehub 6. The bottom 41 of the safety cap 8 may be scored to allow the bottom 41 of the safety cap to break apart before entering the forward opening 36 of nosehub 6. Alternatively, the forward opening 36 of nosehub 6 may be designed to accommodate the bottom 41 of safety cap 8 in any configuration.

Figures 41, 42, 43:
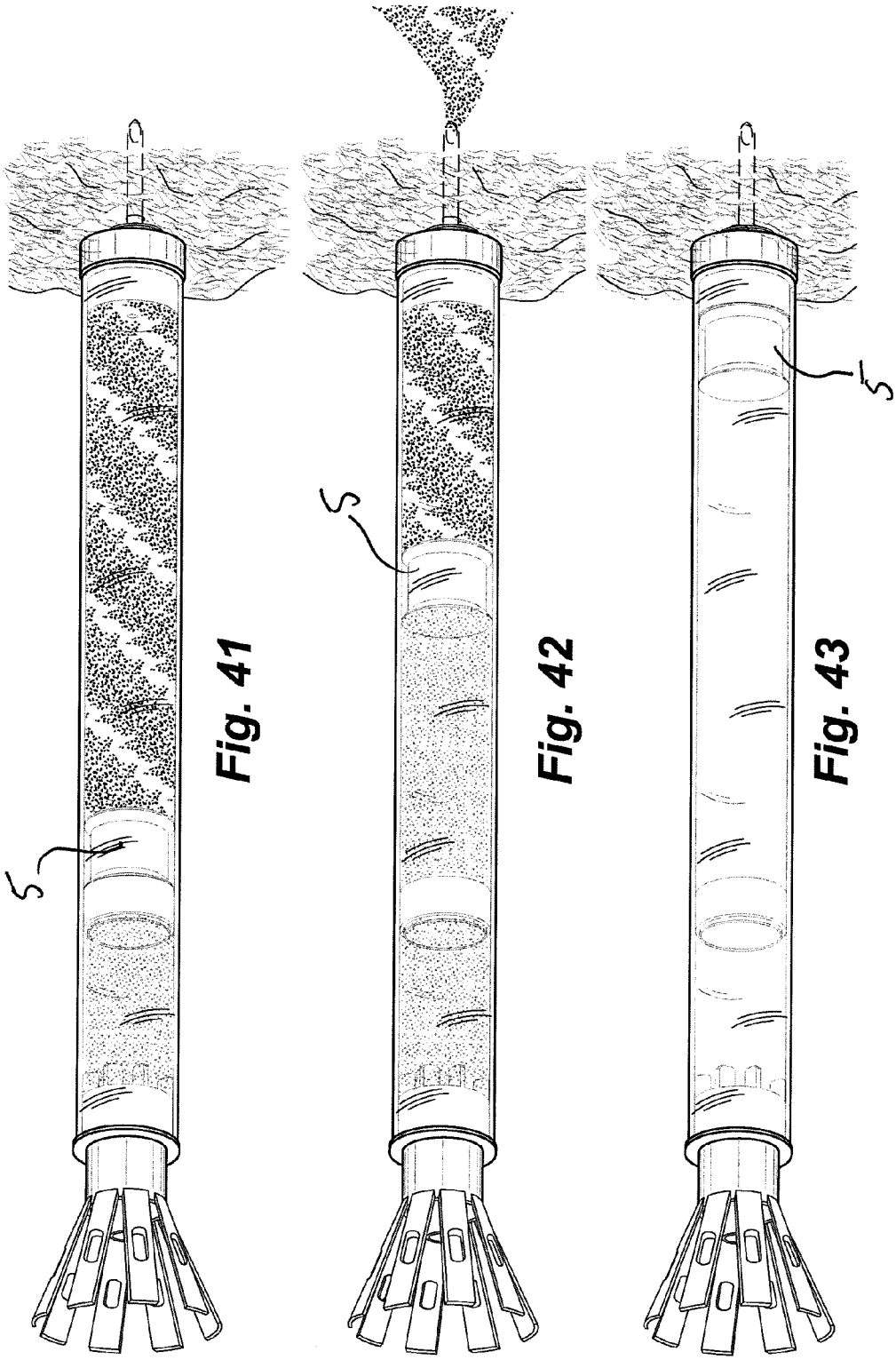
FIG. 41 is a perspective view of an embodiment of the air inject dart of the present invention wherein the dart has penetrated the hide of an animal.
FIG. 42 is a perspective view of an embodiment of the present invention wherein the medication is being injected into the animal.
FIG. 43 is a perspective view of an embodiment of the present invention wherein the medication has been injected into the animal.

FIGS. 41-43 illustrate the injection action of the syringe. FIG. 41 illustrates the fully compressed syringe just after the needle 7 has pierced the animal hide. As the hide is pierced, the compressed air or gas in cylindrical barrel 2 expands. FIG. 42 illustrates the expansion of the compressed air or gas in the cylindrical barrel 2 and the longitudinal movement of the soft plunger 5 forward. The movement of the soft plunger 5 forces the medicine through the nosehub 6 and needle 7 and into the animal. FIG. 43 illustrates the location of the soft plunger 5 against the cylindrical base 32 of the nosehub 6 after the dose of medication has been injected into the animal.

We claim:

1. A syringe for delivering medicine to animals upon pressurization comprising:

a cylindrical barrel having a central axis, a proximal end and a distal end;

a nosehub positioned at the distal end of the cylindrical barrel, wherein the nosehub further comprises;

a center point, a top and a base, wherein the base is placed within the distal end of the cylindrical barrel and the top remains outside of the cylindrical barrel, and a first circular opening located at the center point of the nosehub, wherein the first circular opening extends beyond the base of the nosehub and a second circular opening wherein the first circular opening is larger than the second circular opening and wherein the second circular opening does not extend beyond the base of the nosehub, a tailpiece end cap positioned at the proximal end of the cylindrical barrel, wherein the tailpiece end cap comprises a proximal end further comprising a portal, and a distal end further comprising an air vent, wherein the portal and the air vent are adjacent, a tailpiece comprising a proximal end and a distal end, wherein the distal end of the tailpiece comprises an interior, further comprising an opening, and an exterior wherein the exterior of the distal end of the tailpiece is secured within the portal of the proximal end of the tailpiece end cap, and wherein the tailpiece further comprises;

an air vent, wherein the air vent is located proximally adjacent to the opening, a plurality of flexible fins, wherein the plurality of flexible fins extend longitudinally from the proximal end of the tailpiece and extend beyond the proximal end of the tailpiece and are flexible between 90° and 180° relative to the tailpiece from the distal end of the tailpiece to the proximal end of the tailpiece, a one-way air valve positioned within a space between the air vent of the base of the tailpiece and the air vent of the tailpiece end cap created by the opening of the tailpiece and the portal of the tailpiece end cap, a soft plunger positioned within the cylindrical barrel moveable longitudinally within the cylindrical barrel between the tailpiece end cap and the nosehub, whereby the cylindrical barrel is divided by the soft plunger into an air pressure chamber in the proximal end of the cylindrical barrel and a chamber suitable for receiving medicine in the distal end of the cylindrical barrel, a needle, wherein the needle comprises a proximal end, a central passageway, and a distal end and the proximal end is secured within the first circular opening of the nosehub and the distal end extends beyond the nosehub, a safety cap, wherein the safety cap comprises;

a top, wherein the top comprises a top cylindrical depression, a bottom, wherein the bottom comprises a cylindrical depression and the distal end of the needle is secured within the cylindrical depression of the bottom of the safety cap, and a thin barrier located between the top and bottom wherein the thin barrier is capable of penetration by the distal end of the needle upon impact with an animal, wherein upon penetration by the needle, the safety cap is pushed proximally down the needle and is received within the second circular opening of the nosehub.

2. The syringe of claim 1 wherein the apertures are the thickness of the flexible fins at the proximal end and beveled at the distal end.

3. The syringe of claim 1 wherein the flexible fins are 156.0188° relative to tailpiece from the distal end of the tailpiece to the proximal end of the tailpiece at rest.

4. The syringe of claim 1 further comprising a sleeve insert within the cylindrical barrel, wherein the sleeve insert is positioned between the tailpiece end cap and the soft plunger.

5. The syringe of claim 4 wherein the apertures are the thickness of the longitudinal flexible fins at the proximal end and beveled at the distal end.

6. The syringe of claim 4, wherein the flexible fins are 156.0188° relative to the tailpiece from the distal end of the tailpiece to the proximal end of tailpiece at rest.

* * * * *